US009121084B2

(12) United States Patent
Shishido et al.

(10) Patent No.: US 9,121,084 B2
(45) Date of Patent: Sep. 1, 2015

(54) COPPER ALLOY

(71) Applicant: Kobe Steel, Ltd., Kobe-shi (JP)

(72) Inventors: Hisao Shishido, Kobe (JP); Yuya Sumino, Shimonoseki (JP); Akira Fugono, Shimonoseki (JP)

(73) Assignee: Kobe Steel, Ltd., Kobe-shi (JP)

( * ) Notice: Subject to any disclaimer, the term of this patent is extended or adjusted under 35 U.S.C. 154(b) by 199 days.

(21) Appl. No.: 13/752,771

(22) Filed: Jan. 29, 2013

(65) Prior Publication Data

US 2013/0224070 A1 Aug. 29, 2013

(30) Foreign Application Priority Data

Feb. 24, 2012 (JP) ..... 2012-039364

(51) Int. Cl.
*C22C 9/00* (2006.01)
*C22F 1/08* (2006.01)

(52) U.S. Cl.
CPC .... *C22C 9/00* (2013.01); *C22F 1/08* (2013.01)

(58) Field of Classification Search
None
See application file for complete search history.

(56) References Cited

U.S. PATENT DOCUMENTS

| | | | | |
|---|---|---|---|---|
| 4,260,435 | A * | 4/1981 | Edens et al. | 148/414 |
| 4,678,637 | A * | 7/1987 | Duerrschnabel et al. | 420/490 |
| 4,810,468 | A * | 3/1989 | Duerrschnabel et al. | 420/490 |
| 4,872,048 | A * | 10/1989 | Akutsu et al. | 257/741 |
| 5,601,665 | A * | 2/1997 | Caron et al. | 148/554 |
| 6,322,902 | B1 * | 11/2001 | Takayama et al. | 428/550 |
| 6,482,276 | B2 * | 11/2002 | Hirai et al. | 148/433 |
| 8,317,948 | B2 * | 11/2012 | Era et al. | 148/435 |
| 2002/0015657 | A1 * | 2/2002 | Dong | 420/470 |
| 2002/0039542 | A1 * | 4/2002 | Bogel et al. | 420/492 |
| 2002/0157741 | A1 * | 10/2002 | Yamamoto et al. | 148/685 |
| 2004/0159379 | A1 * | 8/2004 | Bogel et al. | 148/554 |
| 2005/0236074 | A1 * | 10/2005 | Mihara et al. | 148/414 |
| 2006/0180293 | A1 * | 8/2006 | Maehara et al. | 164/459 |
| 2006/0239853 | A1 * | 10/2006 | Maehara et al. | 420/492 |
| 2008/0011396 | A1 * | 1/2008 | Kaneko et al. | 148/684 |
| 2008/0047634 | A1 * | 2/2008 | Mihara et al. | 148/414 |
| 2008/0121320 | A1 * | 5/2008 | Sugawara et al. | 148/685 |
| 2008/0175746 | A1 * | 7/2008 | Era et al. | 420/485 |
| 2008/0190523 | A1 * | 8/2008 | Gao et al. | 148/682 |
| 2008/0190524 | A1 * | 8/2008 | Gao et al. | 148/682 |
| 2008/0210353 | A1 * | 9/2008 | Fukamachi et al. | 148/684 |
| 2008/0298998 | A1 * | 12/2008 | Kaneko et al. | 420/472 |
| 2009/0014102 | A1 * | 1/2009 | Hatakeyama | 148/684 |
| 2009/0025840 | A1 * | 1/2009 | Era et al. | 148/682 |
| 2009/0101243 | A1 * | 4/2009 | Aruga et al. | 148/412 |
| 2009/0301614 | A1 | 12/2009 | Era et al. | |
| 2010/0101687 | A1 * | 4/2010 | Sugawara | |
| 2010/0170595 | A1 * | 7/2010 | Kaneko et al. | 148/554 |
| 2010/0276037 | A1 * | 11/2010 | Yamamoto et al. | 148/501 |
| 2011/0005644 | A1 * | 1/2011 | Matsuo et al. | 148/435 |
| 2011/0027122 | A1 * | 2/2011 | Era et al. | 420/473 |
| 2011/0094635 | A1 * | 4/2011 | Mihara et al. | 148/554 |
| 2011/0186187 | A1 * | 8/2011 | Mihara et al. | 148/554 |
| 2011/0192505 | A1 * | 8/2011 | Kaneko et al. | 148/554 |
| 2011/0200480 | A1 * | 8/2011 | Matsuo et al. | 420/470 |
| 2011/0240180 | A1 * | 10/2011 | Gao et al. | 148/554 |
| 2012/0049130 | A1 * | 3/2012 | Aoyama et al. | 252/513 |
| 2012/0267013 | A1 * | 10/2012 | Kaneko et al. | 148/554 |
| 2012/0288402 | A1 * | 11/2012 | Aruga et al. | 420/481 |
| 2012/0312431 | A1 * | 12/2012 | Kim et al. | 148/554 |
| 2013/0022492 | A1 * | 1/2013 | Kuwagaki | 420/473 |
| 2013/0028784 | A1 * | 1/2013 | Takahashi et al. | 420/471 |
| 2013/0045130 | A1 * | 2/2013 | Aruga et al. | 420/473 |
| 2013/0087255 | A1 * | 4/2013 | Kuwagaki | 148/554 |
| 2014/0010704 | A1 * | 1/2014 | Ishida et al. | 420/471 |
| 2014/0014239 | A1 * | 1/2014 | Mandigo et al. | 148/554 |
| 2014/0014240 | A1 * | 1/2014 | Okafuji et al. | 148/554 |
| 2014/0014241 | A1 * | 1/2014 | Kuwagaki et al. | 148/554 |
| 2014/0193293 | A1 * | 7/2014 | Shishido et al. | 420/473 |

FOREIGN PATENT DOCUMENTS

| | | | |
|---|---|---|---|
| CN | 1793394 | A | 6/2006 |
| JP | 6-81090 | A | 3/1994 |
| JP | 2515127 | B2 | 7/1996 |
| JP | 2005-29857 | A | 2/2005 |
| JP | 3731600 | B2 | 1/2006 |
| KR | 10-2009-0094458 | | 9/2009 |
| WO | WO 2007/138956 | A1 * | 12/2007 |

OTHER PUBLICATIONS machine translation of CN-1793394A (no date available).*

* cited by examiner

*Primary Examiner* — Kiley Stoner
(74) *Attorney, Agent, or Firm* — Oblon, McClelland, Maier & Neustadt, L.L.P.

(57) ABSTRACT

To provide a copper alloy sheet excellent in the balance of strength and electroconductivity and excellent in the balance of strength and bending workability also.

A copper alloy contains predetermined amount of Cr, Ti, and Si so as to satisfy a mass ratio of the Cr to the Ti: $1.0 \leq (Cr/Ti) \leq 30$, and a mass ratio of the Cr to the Si: $3.0 \leq (Cr/Si) \leq 30$, the remainder including copper and unavoidable impurities, in which 70% or more out of total amount of Cr, Ti and Si contained in the copper alloy is precipitated, a number of piece of precipitates with 300 nm or more circle equivalent diameter observed by a SEM in a region of 25 μm in the thickness direction from the surface of the copper alloy×40 μm in the cross-sectional direction in a cross section in the width direction of the copper alloy is 50 pieces or less, and an average circle equivalent diameter of precipitates with less than 300 nm circle equivalent diameter observed by a TEM on the surface of the copper alloy is 15 nm or less.

11 Claims, No Drawings

COPPER ALLOY

BACKGROUND OF THE INVENTION

1. Field of the Invention

The present invention relates to a copper alloy with high strength and high electroconductivity and excellent in bending workability also, and relates more specifically to a copper alloy suitable to materials for various electric and electronic parts used for a connector, lead frame, relay, switch, wiring, terminal and the like constituting electric and electronic parts.

2. Description of the Related Art

In recent years, associated with requirements of miniaturization and weight reduction of electronic apparatuses, electric systems of electric and electronic parts have been more complicated and highly integrated, and characteristics capable of standing thinning and working of a complicated shape are required for materials for various electric and electronic parts.

For example, with respect to the materials for various electric and electronic parts used for current-carrying parts such as a connector, lead frame, relay, switch and the like constituting electric and electronic parts, the cross-sectional area of the material receiving a same load reduces and the cross-sectional area of the material relative to the current-carrying amount also reduces by miniaturization and thinning, therefore excellent electroconductivity is required in order to suppress generation of Joule heat by current-carrying, and high strength capable of standing the stress imparted in assembling and operating electric and electronic apparatuses and bending workability that does not cause breakage and the like even when the electric and electronic parts are bent have been required.

Although a Cu—Fe—P alloy has been used commonly as a material for electric and electronic parts, when an alloy composition such as Sn and the like was added in order to increase the strength, electroconductivity deteriorated and it was difficult to balance the strength and electroconductivity (strength-conductivity balance).

Also, though an alloy of a precipitation hardening type (Cu—Ni—Si alloy) has been proposed as a high strength material, when the content of Ni and Si was reduced in order to improve electroconductivity, the tensile strength dropped, and therefore it was difficult to secure the strength-electroconductivity balance.

As a material superior in the strength-electroconductivity balance compared with conventional Cu—Fe—P alloy and Cu—Ni—Si alloy, a Cu—Cr-based alloy has been proposed (Japanese Unexamined Patent Application Publication No. 2005-29857). However, coarse precipitates were formed in hot rolling, and there was a limit both in increasing the strength and in increasing the electroconductivity.

Also, as a copper alloy excellent in the strength-electroconductivity balance and the workability, a Cu—Cr—Sn-based alloy has been proposed (Japanese Unexamined Patent Application Publication No. H6-081090). However, in the Cu—Cr—Sn-based alloy, a solution heat treatment at high temperature was required, and there were such problems in production that the production process became complicated and the like.

Further, as a copper alloy excellent in strength, electroconductivity and high temperature strength, a Cu—Cr—Ti—Zr alloy has been proposed (Japanese Patent No. 3731600). However, in this copper alloy, the strength and electroconductivity could be improved, but bending workability could not be improved sufficiently.

Also, as a copper alloy excellent in the strength-electroconductivity balance, a Cu—Cr—Ti—Si alloy has been proposed (Japanese Patent No. 2515127). According to this Japanese Patent No. 2515127, consideration was paid for bending workability also, however the copper alloy was not sufficient with respect to bending workability that was severe as described below.

Accompanying weight reduction, miniaturization and the like of electric and electronic apparatuses in recent years, working more complicated than before is executed for materials for electric and electronic parts such as subjecting a material thinned to bending work, executing bending work after subjecting wiring to notching (notching work) into fine width, and the like, therefore requirements not only for improvement of the strength but also for bending workability have become further higher, and a material excellent not only in the strength-electroconductivity balance but also in the strength-bending workability balance has been required.

SUMMARY OF THE INVENTION

The present invention has been developed in view of such circumstances, and its object is to provide a copper alloy excellent in the balance of strength and electroconductivity. Also, the object of the present invention is to provide a copper alloy excellent in the balance of strength and electroconductivity and excellent in bending workability also.

A copper alloy according to of an aspect of the present invention that could solve the problems is a copper alloy containing Cr: 0.10-0.50% (means mass %, hereinafter the same), Ti: 0.010-0.30%, and Si: 0.01-0.10% so as to satisfy a mass ratio of the Cr to the Ti: $1.0 \leq (Cr/Ti) \leq 30$, and a mass ratio of the Cr to the Si: $3.0 \leq (Cr/Si) \leq 30$, the remainder including copper and unavoidable impurities, in which 70% or more out of total amount of Cr, Ti and Si contained in the copper alloy is precipitated, a number of piece of precipitates with 300 nm or more circle equivalent diameter observed by a SEM in a region of 25 μm in the thickness direction from the surface of the copper alloy×40 μm in the cross-sectional direction in a cross section in the width direction of the copper alloy is 50 pieces or less, and an average circle equivalent diameter of precipitates with less than 300 nm circle equivalent diameter observed by a TEM on the surface of the copper alloy is 15 nm or less.

Another embodiment of the present invention is the copper alloy further containing, as other elements, one or more element selected from a group consisting of Fe, Ni and Co: 0.3% or less in total.

Another embodiment is the copper alloy further containing, as another element, Zn: 0.5% or less.

Further, another embodiment is the copper alloy further containing, as other elements, one or more element selected from a group consisting of Sn, Mg and Al: 0.3% or less in total.

A copper alloy according to the present invention has high strength and high electroconductivity of 470 MPa or more tensile strength, 430 MPa or more 0.2% proof stress, and 70% IACS or more of conductance, and has excellent bending workability with 1 or less of R (minimum bending radius)/t (sheet thickness) when W-bending work is executed. Therefore, the copper alloy of the present invention is well balanced in the strength and electroconductivity, and does not cause a crack even in a severe bending work condition while having high strength. The copper alloy of the present invention is suitable particularly to materials for electric and electronic parts.

DETAILED DESCRIPTION OF THE PREFERRED EMBODIMENTS

As a result of studies by the present inventors, it was found out that, in a Cr—Ti—Si-based copper alloy, when coarse precipitates increased, voids and cracks occurred in bending working caused by the coarse precipitates. On the other hand, it was found out that, when fine precipitates were formed much, bending workability could be improved also while maintaining the balance of the strength and electroconductivity. The present inventors found out that a copper alloy having the desired characteristics could be provided by appropriately controlling precipitates and componential composition, and completed the present invention.

For example, in Japanese Patent No. 2515127, in a manufacturing process of executing homogenizing, hot rolling and cooling in order, air cooling is executed after hot rolling. However, as shown in Nos. 31, 34 described below, when cooling after hot rolling is air cooling, comparatively coarse precipitates are formed much. Therefore the bending workability tends to deteriorate compared with examples according to the present invention.

In the present invention, a coarse precipitate means a compound with 300 nm or more of the circle equivalent diameter that is calculated by a measuring method described below. That is, in a cross section in the width direction of a copper alloy (a cross section parallel to the width direction), a region of 25 μm in the thickness direction from the surface of the copper alloy×40 μm in the cross-sectional direction is observed by a scanning electron microscope (SEM) (3,000 magnifications), an area A of the precipitates observed is obtained using an image analysis software, and the circle equivalent diameter 2r (r=radius) is calculated based on $A=\pi r^2$. Also, one with 300 nm or more circle equivalent diameter is made a coarse precipitate.

Further, in the present invention, a fine precipitate that acts effectively means a compound with 15 nm or less of the average circle equivalent diameter that is calculated by a measuring method described below. That is, first, optional locations of the surface of the copper alloy are observed using a transmission electron microscope (TEM) (300,000 magnifications) (number of fields of observation: 3), and the circle equivalent diameter of the precipitate observed is calculated using an image analysis software. Also, for objects of precipitates with the circle equivalent diameter of less than 300 μm, an average value of the circle equivalent diameter of plural precipitates is calculated. In the present invention, when the average circle equivalent diameter is 15 nm or less, the copper alloy is regarded to have fine precipitates. In the present invention, as the precipitates, Cr, $Cr_3Si$, $Ti_5Si_4$ and the like for example formed in the manufacturing process are exemplified.

Below, a copper alloy of the present invention will be described in detail.

First, according to the present invention, 70% or more out of the total amount of specific alloy elements (Cr, Ti and Si) contained in the copper alloy is precipitated. When the precipitation amount is less, the solid solution amount of these alloy elements in the copper alloy increases, which affects adversely on the electroconductivity. Also, when the precipitation amount is less, the strength drops. In order to improve the electroconductivity and strength, it is necessary that 70% or more is precipitated out of the total amount of Cr, Ti and Si contained in the copper alloy, and 75% or more is preferable. Also, though the upper limit of precipitation is not particularly limited, from the viewpoint of the equilibrium solid solution amount, approximately 95% for example is the upper limit.

Although Cr, Ti and Si precipitated may be contained in fine precipitates and coarse precipitates, from the viewpoint of securing the desired effects described above, it is preferable that coarse precipitates are formed less and fine precipitates are formed much, and it is preferable that Cr, Ti and Si precipitated are contained in the fine precipitates. Accordingly, it is preferable that 70% or more is contained and precipitated in the fine precipitates out of the total amount of Cr, Ti and Si contained in the copper alloy, more preferably 75% or more.

Also, fine precipitates only have to contain at least one element of Cr, Ti and Si, and an element other than them (Cu and the like) may be contained. The composition of precipitates can be analyzed by EDX analysis for example.

Further, in the present invention, from the viewpoint of sufficiently exerting the desired characteristics described above, it is important to appropriately control the precipitates. More specifically, it is necessary that the number of piece of coarse precipitates of 300 nm or more calculated by the measuring method described above is 50 pieces or less, and that fine precipitates of 15 nm or less average circle equivalent diameter are present.

With respect to fine precipitates with 15 nm or less average circle equivalent diameter, a pinning force suppressing movement and extinction of dislocation is significantly large compared with a case the average circle equivalent diameter of precipitates exceeds 15 nm, which contributes to improvement of the strength and bending workability. On the other hand, when the average circle equivalent diameter of the precipitates exceeds 15 nm, contribution to improvement of the strength reduces, and high strength cannot be secured. The average circle equivalent diameter of precipitates is to be 15 nm or less, more preferably 10 nm or less. Although the lower limit of the average grain size of precipitates is not particularly limited, when it is excessively small, the pinning force reduces, and therefore it is preferable to be 3 nm or more.

Also, because a crack in bending work occurs from the surface layer, from the viewpoint of securing the balance of the strength and bending workability, the number of pieces of coarse precipitates whose circle equivalent diameter measured by the SEM observation exceeds 300 nm should be controlled. When the coarse precipitates are present much, in bending work exceeding 90° (particularly in W-bending work, 180° bending work, and the like), a defect such as a crack occurs and sufficient bending workability cannot be secured. Also, when coarse precipitates increase excessively, fine precipitates cannot be secured sufficiently, and a strength improving effect and the like due to the fine precipitates cannot be secured sufficiently. Accordingly, the number of piece of coarse precipitates is to be 50 pieces or less, preferably 30 pieces or less.

With respect to the copper alloy of the present invention, in order to secure the desired effects, it is also important to appropriately control the componential composition of the copper alloy in addition to controlling the fine precipitates and the coarse precipitates. Below, the componential composition of the copper alloy of the present invention will be described.

Cr: 0.10-0.50%

Cr has an action of contributing to improvement of the strength of the copper alloy by precipitating as metal Cr of a single body or a compound with Si. When the Cr content is less than 0.10%, it becomes difficult to secure desired strength. Also, when the Cr content is low, the Ti amount precipitated reduces, and the electroconductivity may deteriorate. On the other hand, when the Cr content exceeds 0.50%, coarse precipitates are formed much, which may affect the bending workability adversely. Accordingly, the Cr content is to be 0.10% or more, preferably 0.2% or more, and 0.50% or less, preferably 0.4% or less.

Ti: 0.010-0.30%

Ti has an action of contributing to improvement of the strength of the copper alloy by precipitating as a compound with Si. Also, Ti has effects of lowering the solid solution limit of Cr and Si and promoting precipitation of them. When the Ti content is less than 0.010%, it becomes hard to secure desired strength because precipitates of sufficient amount cannot be formed. On the other hand, when the Ti content exceeds 0.30%, coarse precipitates are formed much, which affects the bending workability adversely. Accordingly, the Ti content is to be 0.010% or more, preferably 0.02% or more, and 0.30% or less, preferably 0.15% or less.

Si: 0.01-0.10%

Si has an action of contributing to improvement of the strength of the copper alloy by precipitating compounds with Cr and Ti. When the Si content is less than 0.01%, it becomes hard to secure desired strength because the amount of the precipitates formed is less. On the other hand, when the Si content exceeds 0.10%, the electroconductivity deteriorates and coarse precipitates are formed much, which may affect the bending workability adversely. Accordingly, the Si content is to be 0.01% or more, preferably 0.02% or more, and 0.10% or less, preferably 0.08% or less.

In the present invention, in order to further improve the strength, electroconductivity, and bending workability with good balance, the content ratios of the additive elements (Cr, Ti, Si) are adjusted so as to be within the ranges described below.

Cr/Ti (Mass Ratio, Hereinafter the Same): 1.0-30

The balance of the mass ratio of Cr to Ti (Cr/Ti) contained in the copper alloy affects the strength and electroconductivity. That is, as Cr/Ti is less, higher strength can be secured. Accordingly, it is preferable to adjust Cr/Ti so as to be 30 or less, preferably 15 or less. Also, when Cr/Ti is less than 1.0, Ti solid solution amount within the copper alloy after aging treatment increases excessively, and the electroconductivity deteriorates. Accordingly, it is preferable to adjust Cr/Ti so as to be 1.0 or more, preferably 3.0 or more.

Cr/Si (Mass Ratio, Hereinafter the Same): 3.0-30

The balance of the mass ratio of Cr to Si (Cr/Si) contained in the copper alloy affects the bending workability and electroconductivity. That is, when Cr/Si increases excessively, the electroconductivity deteriorates. Accordingly, it is preferable to adjust Cr/Si so as to be 30 or less, preferably 20 or less. Also, when Cr/Si is less than 3.0, the compound of Cr and Si are formed as coarse precipitates, which affects the bending workability adversely. Also, the solid solution amount of other elements may possibly increase and the electroconductivity may possibly deteriorate. Accordingly, it is preferable to adjust Cr/Si so as to be 3.0 or more, preferably 10 or more.

The present invention satisfies the componential composition, Cr/Ti, and Cr/Si described above, and the remainder is copper and unavoidable impurities. As the unavoidable impurities, elements such as V, Nb, Mo, W and the like for example are exemplified. When the content of the unavoidable impurities increases, the strength, electroconductivity, bending workability and the like may be deteriorated, therefore it is preferable to make the content of the unavoidable impurities 0.1% or less, more preferably 0.05% or less in terms of the total content.

In the present invention, elements described may be further added to the copper alloy.

At least one element selected from a group consisting of Fe, Ni and Co: 0.3% or less in total (the single content when Fe, Ni and Co are contained alone, and the total content when plural elements are contained)

Fe, Ni and Co have actions of precipitating compounds with Si and improving the strength and electroconductivity of the copper alloy. When the content increases excessively, the solid solution amount increases and the electroconductivity deteriorates, and therefore the content is to be preferably 0.3% or less, more preferably 0.2% or less. On the other hand, when the content is excessively low, the improvement effect of the strength and electroconductivity cannot be secured sufficiently, and therefore the content is to be preferably 0.01% or more, more preferably 0.03% or more.

Zn: 0.5% or Less

Zn has effects of improving the thermal delamination resistance of Sn plating and solder used for joining electric parts and suppressing thermal delamination. In order to exert such effects effectively, it is preferable to contain by 0.005% or more, more preferably 0.01% or more. However, when it is contained excessively much, the wet expandability of molten Sn and solder deteriorates by contraries and the electroconductivity deteriorates, and therefore Zn is preferable to be 0.5% or less.

At least one element selected from a group consisting of Sn, Mg and Al: 0.3% or less in total (the single content when Sn, Mg and Al are contained alone, and the total content when plural elements are contained)

Sn, Mg and Al have an effect of improving the strength of the copper alloy by solid solution. In order to exert such effect sufficiently, it is preferable to be contained by 0.01% or more, more preferably 0.03% or more. On the other hand, when the content is excessively high, the electroconductivity deteriorates and desired characteristics cannot be obtained, and therefore the content is preferable to be 0.3% or less.

Next, a preferable manufacturing condition in relation with the copper alloy related with the present invention will be described. First, an ingot obtained by melting and casting a copper alloy whose componential composition has been adjusted is heated (including homogenizing heat treatment) and is thereafter subjected to hot rolling, and a sheet after hot rolling is cooled rapidly at a cooling rate exceeding air cooling. Then, cold rolling is executed, aging treatment is thereafter executed, and thereby the copper alloy of the present invention is manufactured.

Melting, casting and heat treatment thereafter of the copper alloy can be executed by an ordinary method. For example, the copper alloy adjusted to a predetermined componential composition is molten by an electric furnace, and a copper alloy ingot is thereafter casted by continuous casting and the like. Thereafter, the ingot is heated to approximately 800-1,000° C., and is maintained for a constant time (10-120 min for example) according to the necessity.

In the hot rolling process next, as is heated to a high temperature, sufficient solid solution state is obtained and fine precipitates can be formed by an aging treatment described below, and therefore it is preferable to be approximately 800-1,000° C. It is preferable that the hot rolling finishing temperature is 600° C. or above, more preferably 650° C. or above. When hot rolling is executed at a temperature range of below 600° C., coarse precipitates are easily formed and the bending workability of the copper alloy manufactured deteriorates. The draft may be set appropriately so as to obtain a desired product sheet, however, from the viewpoint of productivity, preferable draft of hot rolling is approximately 50% or more and 80% or less.

When the cooling rate after hot rolling is slow (air cooling for example), growth and coarsening of precipitates proceed. When precipitates are coarsened, stress is concentrated at the precipitates and the like in bending work and a crack is liable to occur. In the present invention, from the viewpoint of suppressing coarse precipitates, rapid cooling is executed to the room temperature after hot rolling. Average cooling rate in cooling is to be a rate exceeding air cooling and is preferable to be 10° C./s or more, more preferably 20° C./s or more. The upper limit of the cooling rate is not particularly limited. As a means for rapid cooling, water cooling can be cited for example.

For a hot rolled sheet after cooling, cold rolling is executed with a predetermined draft. By executing cold rolling, the lattice defects that work as nuclei for generation of precipitates in aging treatment described below can be introduced, and precipitates can be generated more homogeneously. Although the draft may be adjusted appropriately so as to secure desired sheet thickness, from the viewpoint of introducing the lattice defects sufficiently, the draft is preferable to be 80% or more for example, and is preferable to be less than 95%.

After cold rolling, aging treatment is executed. By properly executing the aging treatment, the predetermined fine precipitates can be secured, and the strength, electroconductivity and bending workability of the copper alloy can be improved.

Aging treatment is executed at the temperature of over 300° C.-650° C. for approximately 30 min-10 hours, and cooling is executed by water cooling or radiation cooling after aging. When the aging treatment temperature is excessively high, the size of precipitates becomes large, and fine precipitates cannot be secured. Accordingly, the strength and electroconductivity of the copper alloy deteriorate, and therefore the aging treatment temperature is preferable to be 650° C. or below, more preferably 600° C. or below. On the other hand, when the aging temperature is excessively low, aging does not proceed sufficiently, Cr and the like cannot be precipitated sufficiently, and therefore the aging treatment temperature is preferable to be over 300° C., more preferably 350° C. or above.

After the aging treatment, cold rolling may be executed and the strength and the like may be adjusted according to the necessity, when it is also preferable to execute annealing to remove the strain.

EXAMPLES

Although the present invention will be explained below further specifically referring to examples, the present invention is not limited by the examples below, it is a matter of course that the present invention can be also implemented with modifications being added appropriately within the scope adaptable to the purposes described above and below, and any of them is to be included within the technical range of the present invention.

A copper alloy was molten in a kryptol furnace in the atmosphere under coverage of charcoal and was casted with a book mold made of cast iron, and ingots with 45 mm thickness having the chemical composition described in Table 1 were obtained. After the surface of the ingot was subjected to facing, the ingot was heated to reach 950° C., was maintained thereafter for 30 min-2 hours, was hot rolled thereafter until the thickness became 10 mm, and was water cooled from the temperature of 750° C. or above (average cooling rate: 20° C./s). Also, with respect to Nos. 31, 34, the cooling method was changed to air cooling (average cooling rate: 0.5° C./s). The surface of the rolled sheet was subjected to facing to remove oxidized scale to obtain 8.0 mm thickness, was thereafter cold rolled to obtain a copper alloy sheet with 0.5 mm thickness. Thereafter aging treatment (2 hours) was executed by a batch annealing furnace at the temperature shown in Table 2.

Samples were cut out from the copper alloy sheet obtained, and measurement and structural analysis of precipitates (rate of Cr, Ti, Si, tensile strength, 0.2% proof stress, electroconductivity, bending workability) were executed by a procedure described below. These results are shown in Tables 2, 3.

(Measurement of Average Circle Equivalent Diameter of Precipitates)

The copper alloy structure of the sample surface (optional location) was observed by a TEM (transmission electron microscope, magnification: 300,000 times) (3 fields of view), optional 50 pieces of precipitates were selected, the area A of each precipitate was obtained using an image analysis software (Image-Pro Plus made by Macromedia Inc.), and the circle equivalent diameter 2r was calculated. Also, the average circle equivalent diameter of the precipitates with less than 300 nm circle equivalent diameter was obtained.

(Number of Piece of Coarse Precipitates)

In a cross section in the width direction of the sample, a region of 25 μm in the thickness direction from the surface of the sample×40 μm in the cross-sectional direction was observed by a SEM (scanning electron microscope, magnification: 3,000 times), the circle equivalent diameter of each precipitate was calculated using an image analysis software (Image-Pro Plus made by Macromedia Inc.), and its number of piece (number of piece inside the measurement range (25 μm×40 μm)) was obtained.

According to the present invention, one in which the number of piece of coarse precipitates with 300 nm or more circle equivalent diameter was 50 pieces or less was evaluated to be excellent.

(Analysis of Composition Contained in Precipitates)

The composition contained in the precipitates of less than 300 nm and the precipitates of 300 nm or more was measured by EDX analysis, and the rate of the total amount of Cr, Ti and Si in the precipitates to the amount of addition (the Cr, Ti and Si amount described in Table 1 was made 100%) was calculated by a method described below and was described in Table 2 ("precipitation rate of Cr, Ti, Si").

An additive element contained in fine precipitates formed by aging treatment was estimated from variation in conductance before and after the aging treatment. That is, because the conductance varied significantly by the solid solution element content as shown in Linde's rule, the precipitated phase formed by aging was assumed, and variation in the solid solution element amount by aging, that was the content of the element contained in the precipitate formed by aging, was calculated from variation in the conductance by aging. With respect to the precipitated phase, the precipitated phase and the rate of the precipitated phase in an equilibrium state calculated from a calculation state diagram software "pandat" were used.

For example, in the case of sample No. 1, according to the calculation state diagram, $Cr_3Si$, Cr, $Ti_5Si$ were formed, and respective phases were formed by the rate of $Cr_3Si$:Cr:$Ti_5Si$=9.9:1:3.4 respectively in terms of mass %. Accordingly, respective elements contained in the precipitated phase are Cr:Ti:Si=10:2.3:1 respectively in terms of mass %. By Linde's rule, the variation amount Δρ of the specific resistance value by the solid solution element can be calculated by the expression (1) below.

$$\Delta\rho=(\text{solid solution Cr})\times\Delta\rho cr+(\text{solid solution Ti})\times\Delta\rho ti+(\text{solid solution Si})\times\Delta\rho si=(\text{added Cr-precipitated Cr})\times\Delta\rho cr+(\text{added Ti-precipitated Ti})\times\Delta\rho ti+(\text{added Si-precipitated Si})\times\Delta\rho si=(\text{added Cr-10}\times\text{precipitated Si})\times\Delta\rho cr+(\text{added Ti-2.3}\times\text{precipitated Si})\times\Delta\rho ti+(\text{added Si-precipitated Si})\times\Delta\rho si \quad (1)$$

wherein Δρcr, Δρti, Δρsi represent influence the solid solution elements exert on the specific resistance value, and are $4.1\times10^8$, $16\times10^8$, $3.1\times10^8$ (Ω·m) respectively. Also, the variation amount Δρ of the specific resistance value by the solid solution element can be calculated by the expression (2) below with respect to the conductance Ec and the specific resistance ρcu of the standard copper.

$$Ec=\rho cu/(\rho cu+\Delta\rho) \quad (2)$$

By using the expression (1) and the expression (2), Cr, Ti, Si amount in the precipitates before and after the aging treatment can be calculated.

(Tensile Strength/Proof Stress)

Specimens (size: JIS No. 5) were manufactured by being cut out in parallel with the rolling direction, and the tensile strength and 0.2% proof stress were measured in the condition of the room temperature, 10.0 mm/min test speed, and GL=50 mm by a model 5882 universal tester made by Instron Corporation. According to the present invention, 470 MPa or more tensile strength was evaluated to be excellent. Also, 430 MPa or more 0.2% proof stress was evaluated to be excellent.

(Electroconductivity)

Specimens of a strip shape with 10 mm width×300 mm length were machined by milling, electric resistance was measured by a double bridge type resistance measurement apparatus, and the electroconductivity was calculated by an average cross-sectional area method. According to the present invention, 70% (IACS) or more of the electroconductivity was evaluated to be excellent.

(Bending Workability)

The bending test was executed according to the Technical Standards of Japan Copper and Brass Association. The W-bending test was executed using samples obtained by cutting a sheet material into 10 mm width×30 mm length. While executing W-bending work, presence/absence of a crack in bending sections was observed by an optical microscope with 10 magnifications. Also, a ratio R/t of the minimum bending radius R that did not cause a crack to the sheet thickness t (0.50 mm) of the copper alloy sheet was obtained. When the R/t is smaller, it shows that the bending workability is excellent, and 1.0 or less was evaluated to be excellent (o) and over 1.0 was evaluated to be bad (×) in the present invention.

TABLE 1

| Sample | Chemical composition (mass %, remainder: Cu and unavoidable impurities) | | | | | | | |
|---|---|---|---|---|---|---|---|---|
| No. | Cr | Ti | Si | Fe, Ni, Co | Zn | Sn, Mg, Al | Cr/Ti | Cr/Si |
| 1 | 0.25 | 0.049 | 0.02 | — | — | — | 5.1 | 12.5 |
| 2 | 0.15 | 0.050 | 0.02 | — | — | — | 3.0 | 7.5 |
| 3 | 0.42 | 0.051 | 0.05 | — | — | — | 8.2 | 8.4 |
| 4 | 0.28 | 0.120 | 0.03 | — | — | — | 2.3 | 9.3 |
| 5 | 0.20 | 0.052 | 0.06 | — | — | — | 3.8 | 3.3 |
| 6 | 0.33 | 0.230 | 0.03 | — | — | — | 1.4 | 11.0 |
| 7 | 0.40 | 0.015 | 0.03 | | | | 26.7 | 13.3 |
| 8 | 0.29 | 0.048 | 0.01 | — | — | — | 6.0 | 29.0 |
| 9 | 0.25 | 0.051 | 0.02 | Fe: 0.02 | — | — | 4.9 | 12.5 |
| 10 | 0.25 | 0.053 | 0.02 | Ni: 0.02 | — | — | 4.7 | 12.5 |
| 11 | 0.25 | 0.051 | 0.02 | Co: 0.02 | — | — | 4.9 | 12.5 |
| 12 | 0.25 | 0.051 | 0.02 | Fe: 0.1, Ni: 0.1 | — | — | 4.9 | 12.5 |
| 13 | 0.25 | 0.048 | 0.02 | — | 0.05 | — | 5.2 | 12.5 |
| 14 | 0.25 | 0.049 | 0.02 | Fe: 0.01, Ni: 0.01 | 0.05 | — | 5.1 | 12.5 |
| 15 | 0.26 | 0.048 | 0.02 | — | — | Sn: 0.1 | 5.4 | 13.0 |
| 16 | 0.26 | 0.038 | 0.02 | — | — | Sn: 0.25 | 6.8 | 13.0 |
| 17 | 0.30 | 0.051 | 0.02 | — | — | Mg.: 0.03 | 5.9 | 15.0 |
| 18 | 0.30 | 0.052 | 0.02 | Fe: 0.01, Ni: 0.01 | 0.05 | Sn: 0.1 | 5.8 | 15.0 |
| 19 | 0.29 | 0.050 | 0.02 | — | — | Al: 0.01 | 5.8 | 14.5 |
| 20 | 0.25 | 0.049 | 0.02 | — | — | — | 5.1 | 12.5 |
| 21 | 0.25 | 0.049 | 0.02 | — | — | — | 5.1 | 12.5 |
| 22 | 0.60 | 0.052 | 0.02 | — | — | — | 11.5 | 30.0 |
| 23 | 0.05 | 0.028 | 0.01 | | | | 1.8 | 5.0 |
| 24 | 0.30 | 0.394 | 0.05 | — | — | — | 0.8 | 6.0 |
| 25 | 0.28 | 0.005 | 0.02 | | | | 56.0 | 14.0 |
| 26 | 0.30 | 0.050 | 0.17 | — | — | — | 6.0 | 1.8 |
| 27 | 0.10 | 0.206 | 0.02 | — | — | — | 0.5 | 5.0 |
| 28 | 0.15 | 0.053 | 0.08 | — | — | — | 2.8 | 1.9 |
| 29 | 0.30 | 0.052 | 0.02 | Fe: 0.5 | — | — | 5.8 | 15.0 |
| 30 | 0.30 | 0.049 | 0.02 | — | — | Sn: 0.5 | 6.1 | 15.0 |
| 31 | 0.28 | 0.068 | 0.02 | — | — | — | 4.1 | 14.0 |
| 32 | 0.25 | 0.049 | 0.02 | — | — | — | 5.1 | 12.5 |
| 33 | 0.25 | 0.049 | 0.02 | — | — | — | 5.1 | 12.5 |
| 34 | 0.25 | 0.049 | 0.02 | — | — | — | 5.1 | 12.5 |

TABLE 2

| Sample No. | Cooling after hot rolling | Hot rolling draft (%) | Cold rolling draft (%) | Aging treatment temperature (° C.) | Precipitation rate of Cr, Ti, Si (%) | Number density of coarse precipitate (piece) | Average circle equivalent diameter of precipitates (nm) |
|---|---|---|---|---|---|---|---|
| 1 | Water cooling | 78 | 94 | 450 | 83 | 22 | 5 |
| 2 | Water cooling | 78 | 94 | 450 | 74 | 16 | 5 |
| 3 | Water cooling | 78 | 94 | 450 | 89 | 42 | 8 |
| 4 | Water cooling | 78 | 94 | 450 | 89 | 28 | 7 |
| 5 | Water cooling | 78 | 94 | 450 | 83 | 27 | 5 |
| 6 | Water cooling | 78 | 94 | 500 | 94 | 48 | 4 |
| 7 | Water cooling | 78 | 94 | 450 | 78 | 18 | 6 |
| 8 | Water cooling | 78 | 94 | 450 | 82 | 13 | 9 |
| 9 | Water cooling | 78 | 94 | 450 | 85 | 25 | 5 |
| 10 | Water cooling | 78 | 94 | 450 | 82 | 18 | 5 |
| 11 | Water cooling | 78 | 94 | 450 | 90 | 29 | 4 |
| 12 | Water cooling | 78 | 94 | 450 | 84 | 43 | 5 |
| 13 | Water cooling | 78 | 94 | 450 | 82 | 16 | 5 |
| 14 | Water cooling | 78 | 94 | 450 | 85 | 16 | 5 |
| 15 | Water cooling | 78 | 94 | 450 | 86 | 14 | 5 |
| 16 | Water cooling | 78 | 94 | 450 | 82 | 23 | 5 |
| 17 | Water cooling | 78 | 94 | 450 | 78 | 18 | 5 |
| 18 | Water cooling | 78 | 94 | 450 | 89 | 23 | 9 |
| 19 | Water cooling | 78 | 94 | 450 | 81 | 21 | 5 |
| 20 | Water cooling | 78 | 94 | 400 | 77 | 19 | 3 |
| 21 | Water cooling | 78 | 94 | 500 | 88 | 19 | 8 |
| 22 | Water cooling | 78 | 94 | 450 | 84 | 73 | 12 |
| 23 | Water cooling | 78 | 94 | 450 | 81 | 14 | 7 |
| 24 | Water cooling | 78 | 94 | 450 | 76 | 134 | 16 |
| 25 | Water cooling | 78 | 94 | 450 | 68 | 19 | 10 |
| 26 | Water cooling | 78 | 94 | 450 | 76 | 70 | 5 |
| 27 | Water cooling | 78 | 94 | 450 | 51 | 32 | 5 |
| 28 | Water cooling | 78 | 94 | 450 | 72 | 66 | 5 |
| 29 | Water cooling | 78 | 94 | 450 | 86 | 93 | 5 |
| 30 | Water cooling | 78 | 94 | 450 | 82 | 17 | 5 |
| 31 | Air cooling | 78 | 94 | 450 | 87 | 74 | 7 |
| 32 | Water cooling | 78 | 94 | 300 | 27 | 19 | 3 |
| 33 | Water cooling | 78 | 94 | 700 | 63 | 19 | 33 |
| 34 | Air cooling | 78 | 94 | 450 | 86 | 63 | 7 |

TABLE 3

| Sample No. | Characteristics of copper alloy | | | |
|---|---|---|---|---|
| | Tensile strength (MPa) | Proof stress (Mpa) | Conductance (% IACS) | W-bending evaluation (R/t = 1.0 or less |
| 1 | 532 | 510 | 82.0 | ○ |
| 2 | 514 | 492 | 79.2 | ○ |
| 3 | 548 | 521 | 82.1 | ○ |
| 4 | 543 | 523 | 71.4 | ○ |
| 5 | 529 | 502 | 74.4 | ○ |
| 6 | 516 | 493 | 70.2 | ○ |
| 7 | 488 | 476 | 85.7 | ○ |
| 8 | 501 | 489 | 83.8 | ○ |
| 9 | 542 | 518 | 81.4 | ○ |
| 10 | 533 | 514 | 81.6 | ○ |
| 11 | 528 | 508 | 83.8 | ○ |
| 12 | 512 | 485 | 74.2 | ○ |
| 13 | 526 | 505 | 80.4 | ○ |
| 14 | 519 | 501 | 81.1 | ○ |
| 15 | 544 | 523 | 78.2 | ○ |
| 16 | 566 | 538 | 70.6 | ○ |
| 17 | 536 | 510 | 80.3 | ○ |
| 18 | 558 | 541 | 78.6 | ○ |
| 19 | 530 | 508 | 81.7 | ○ |
| 20 | 527 | 513 | 77.6 | ○ |
| 21 | 497 | 479 | 84.6 | ○ |
| 22 | 544 | 521 | 73.2 | x |
| 23 | 438 | 417 | 68.3 | ○ |
| 24 | 460 | 451 | 31.6 | x |
| 25 | 462 | 445 | 77.3 | ○ |
| 26 | 472 | 462 | 64.1 | x |
| 27 | 420 | 408 | 36.5 | ○ |
| 28 | 442 | 418 | 67.5 | ○ |
| 29 | 418 | 406 | 64.4 | ○ |

TABLE 3-continued

| Sample No. | Characteristics of copper alloy | | | |
|---|---|---|---|---|
| | Tensile strength (MPa) | Proof stress (Mpa) | Conductance (% IACS) | W-bending evaluation (R/t = 1.0 or less |
| 30 | 585 | 562 | 57.3 | x |
| 31 | 503 | 471 | 81.4 | x |
| 32 | 473 | 462 | 46.3 | x |
| 33 | 410 | 396 | 62.2 | ○ |
| 34 | 486 | 469 | 82.9 | x |

Nos. 1-21 are examples that satisfy the stipulation of the present invention, and all of them obtained sufficient strength (tensile strength and 0.2% proof stress), electroconductivity, and bending workability.

No. 22 is an example in which the Cr content is more than the stipulation of the present invention. In No. 22, because the Cr content was much, coarse precipitates were formed by a large amount, and sufficient bending workability could not be secured.

No. 23 is an example in which the Cr content is less than the stipulation of the present invention. In No. 23, because the Cr content was less, the Ti amount that was solid-resolved without precipitation increased, the electroconductivity deteriorated, and sufficient strength could not be secured.

No. 24 is an example in which the Ti content is more than the stipulation of the present invention and the Cr/Ti ratio is less than the stipulation of the present invention. In No. 24, coarse precipitates were formed by a large amount, Ti solid solution amount increased, and the strength, bending workability, and electroconductivity were inferior.

No. 25 is an example in which the Ti content is less than the stipulation of the present invention, the Cr/Ti ratio exceeds the stipulation of the present invention, and the precipitation rate of Cr, Ti, Si is less. In No. 25, sufficient strength could not be secured.

No. 26 is an example in which the Si content is more than the stipulation of the present invention, and the Cr/Si ratio is less than the stipulation of the present invention. In No. 26, coarse precipitates were formed by a large amount, the electroconductivity was inferior, and sufficient bending workability could not be secured.

No. 27 is an example in which the Cr/Si ratio is less than the stipulation of the present invention, and the precipitation amount of Cr, Ti, Si is less. In No. 27, sufficient strength could not be secured, and the electroconductivity was also inferior.

No. 28 is an example in which the Cr/Si ratio is less than the stipulation of the present invention. In No. 28, sufficient strength could not be secured, and the electroconductivity was also inferior.

No. 29 is an example in which the Fe content is more than the stipulation of the present invention, and coarse precipitates are formed by a large amount. In No. 29, sufficient strength could not be secured, and the electroconductivity was also inferior.

No. 30 is an example in which the Sn content is more than the stipulation of the present invention. In No. 30, the electroconductivity was inferior, and the bending workability was also inferior.

No. 31 is an example in which cooling after hot rolling is air cooling. In No. 31, because the cooling rate was slow, coarse precipitates were formed much, and sufficient bending workability could not be secured.

No. 32 is an example in which the aging treatment temperature is low. In No. 32, because the aging treatment temperature was low, Cr, Ti, Si could not be precipitated sufficiently, the electroconductivity was inferior, and the bending workability was also inferior.

No. 33 is an example in which the aging treatment temperature is high. In No. 33, because the aging treatment temperature was high, the average circle equivalent diameter of the precipitates exceeded 15 nm. Accordingly, sufficient strength could not be secured, and the electroconductivity was also inferior.

No. 34 is an example in which cooling after hot rolling is air cooling. In No. 34, because the cooling rate was slow, coarse precipitates were formed much, and sufficient bending workability could not be secured.

What is claimed is:

1. A copper alloy, comprising, in mass % of the alloy:

from 0.10 to 0.50% Cr;

from 0.010 to 0.30% Ti;

from 0.01 to 0.10% Si; and a remainder comprising copper and, optionally, unavoidable impurities, wherein a mass ratio of the Cr to the Ti satisfies $1.0 \leq (Cr/Ti) \leq 30$, a mass ratio of the Cr to the Si satisfies $3.0 \leq (Cr/Si) \leq 30$, a content of Fe, Ni, and/or Co, if present, is 0.3% or less in total, by mass of the alloy, 70% or more out of a total amount of Cr, Ti, and Si contained in the copper alloy is precipitated, a number of pieces of precipitates with 300 nm or more circle equivalent diameter as observed by a SEM in a region of 25 μm in the thickness direction from the surface of the copper alloy×40 μm in the cross-sectional direction in a cross section in the width direction of the copper alloy is 50 pieces or less, an average circle equivalent diameter of precipitates with less than 300 nm circle equivalent diameter as observed by a TEM on the surface of the copper alloy is 15 nm or less, and wherein the copper alloy is not a Cu—Fe—P alloy.

2. The copper alloy according to claim 1, further comprising:

one or more element selected from the group consisting of Fe, Ni, and Co in a content of greater than 0 and 0.3% or less in total.

3. The copper alloy according to claim 1 or 2, further comprising:

Zn in a content of greater than 0 and 0.5% or less.

4. The copper alloy according to claim 1, further comprising:

one or more element selected from the group consisting of Sn, Mg, and Al in a content of greater than 0 and 0.3% or less in total.

5. The copper alloy of claim 1, obtained by a process comprising hot rolling to obtain an alloy sheet, then cooling the alloy sheet at a cooling rate exceeding a rate of air cooling.

6. The copper alloy of claim 5, wherein the cooling rate is 10° C/s or more.

7. The copper alloy of claim 5, wherein the cooling of the alloy sheet comprises water cooling.

8. The copper alloy of claim 5, wherein the process further comprises aging at a temperature of greater than 300° C. and not greater than 650° C.

9. The copper alloy of claim 1, wherein a conductance of the alloy is 70% IACS or more.

10. The copper alloy of claim 1, wherein an average circle equivalent diameter of precipitates observed by a TEM on the surface of the copper alloy is 15 nm or less.

11. The copper alloy of claim 10, wherein the average circle equivalent diameter of precipitates observed by a TEM on the surface of the copper alloy is 10 nm or less.

* * * * *